US006898373B2

(12) United States Patent
Jackson

(10) Patent No.: US 6,898,373 B2
(45) Date of Patent: May 24, 2005

(54) TANK APPARATUS WITH OPEN WEAVE REINFORCING PATCH STRUCTURE

(75) Inventor: Barry N. Jackson, Woodbury, MN (US)

(73) Assignee: Rheem Manufacturing Company, New York, NY (US)

( * ) Notice: Subject to any disclaimer, the term of this patent is extended or adjusted under 35 U.S.C. 154(b) by 0 days.

(21) Appl. No.: 10/667,621

(22) Filed: Sep. 22, 2003

(65) Prior Publication Data

US 2005/0063688 A1 Mar. 24, 2005

(51) Int. Cl.[7] ..... F24H 1/20
(52) U.S. Cl. ..... 392/451; 220/590; 156/166
(58) Field of Search ..... 156/166–180; 220/590; 392/441–449

(56) References Cited

U.S. PATENT DOCUMENTS 3,112,234 A * 11/1963 Krupp ..... 156/169
3,847,716 A * 11/1974 Dorsch ..... 428/37
4,357,962 A 11/1982 Shaw et al. ..... 138/125
4,614,279 A 9/1986 Toth et al. ..... 220/3
4,740,262 A 4/1988 Yavorsky et al. ..... 156/293
4,765,507 A 8/1988 Yavorsky et al. ..... 220/414

* cited by examiner

*Primary Examiner*—Thor S. Campbell
(74) *Attorney, Agent, or Firm*—Konneker & Smith, P.C.

(57) ABSTRACT

A filament-wound tank portion of an electric water heater has a wall opening through which an electric heating element of other structure extends into the interior of the tank. The opening is reinforced by a stacked series of single layer, open weave patch members which are interdigitated with layers of the filament winding and through which the opening extends. The filament winding and the patches are impregnated with and intersecured by a cured resin material. As an alternative to cutting portions of the patches during formation of the tank wall opening, the patches may be provided with suitable pre-formed openings with reinforced peripheries, the subsequently formed tank wall opening extending through these reinforced, pre-formed patch openings. The single layer, open weave patches are also utilized to reinforce other types of filament-based tank wall structures.

49 Claims, 2 Drawing Sheets

TANK APPARATUS WITH OPEN WEAVE REINFORCING PATCH STRUCTURE

BACKGROUND OF THE INVENTION

The present invention generally relates to pressure vessels, such as water heater storage tanks and, in a preferred embodiment thereof, more particularly provides a filament-wound plastic water heater tank in which a specially designed patch structure is utilized to reinforce an opening extending inwardly through the exterior filament winding and the tank wall.

Filament-wound pressure tanks, such as those incorporated in various types of water heaters, are typically constructed using an inner tank body which may be representatively of a blow-molded plastic construction. To reinforce the inner tank body it is exteriorly wound with a resin-impregnated filament, such as a fiberglass filament material, in a combination of helical and circumferential wraps such that the finished filament winding comprises a series of filament material layers. The applied filament winding on the exterior of the tank body is then cured to harden it to thereby substantially reinforce the tank body to permit it to handle internal operating pressure levels that It might not otherwise be able to withstand.

If the filament-wound tank requires the formation of a wall opening therein, such as a heating element sidewall opening in a water heater tank, it is necessary to cut the filament fibers to extend the opening into the tank interior. This hole-cutting operation substantially weakens the exterior reinforcing portion of the overall tank structure. To compensate for this weakening, one or more reinforcing patches are applied to the tank structure. These patches are designed to help tie the cut filament fibers to each other and to different layers of the filament winding.

Conventionally, these reinforcing patches are of a multi-layered triaxial design, with different fiber directions in the layers, and are customarily of a tight weave, sometimes being knitted to retain their shape and body. The multilayered tight-weave patches are applied to the tank within the various filament winding layers to reinforce the area and fibers that will be cut when the tank opening is subsequently formed. Each patch is soaked in the resin material to help bond it to the layers of the filament winding, with each patch being of a very tight weave and thick construction to help transfer the load in the different directions of the windings around the tank. The design goal of utilizing this type of patch structure is to cause the installed tight weave, multi-layer patches to bond to the different layers of the filament windings with the resin soaked into the patch and the filament fibers.

In the formation of filament-wound tanks (as well as filament-based tanks of various non-wound varieties), this conventional patch reinforcing technique has several problems, limitations and disadvantages. For example, this type of patch structure is often prone to failure, thereby substantially weakening the strength of the tank, due to delamination of the various individual patch elements caused by stress on their outer layers by filament windings bonded thereto. This problem arises from the difficulty of adequately resin-bonding the various layers of each individual patch member to one another. Additionally, it is often difficult to assure that resin flows completely through each patch. Moreover, the conventional large thickness of these multilayer patches undesirably places additional stress on the contiguous filament layers by causing them to sharply bend around the patch edges.

As can be readily seen from the foregoing, a need exists for an improved hole-reinforcing patch technique in the production of filament-based pressure tanks such as the filament winding reinforced water storage tank portions of water heaters. It is to this need that the present invention is directed.

SUMMARY OF THE INVENTION

In carrying out principles of the present invention, in accordance with a preferred embodiment thereof, an electric water heater is provided with a specially designed filament-wound water storage tank apparatus disposed within an outer jacket, a cavity disposed between the tank apparatus and jacket structure being filled with a suitable insulation material. Heating apparatus including an immersible electric resistance heating element is provided for heating water stored in the tank structure for on-demand delivery therefrom.

From a broad perspective, the tank structure in a representative embodiment thereof includes a tank which is representatively of a blow-molded plastic construction and adapted to hold a quantity of water to be heated, and a wound filament structure extending externally around and reinforcing the tank. At least one single layer, open weave reinforcing patch is disposed between the tank and the outer surface of the wound filament structure and is secured to the wound filament structure, illustratively by a cured resin material with which the filament winding portion of the wound filament structure and the at least one single layer, open weave reinforcing patch are impregnated. An opening, which sealingly receives the electric heating element (or some other structure extending into the tank), extends into the interior of the tank from the outer surface of the wound filament structure and through the at least one single layer, open weave reinforcing patch. The tank opening may extend through a side wall portion or an end wall portion of the tank, and the tank may be provided with more than one reinforced side wall and/or end wall openings.

In an illustrated embodiment of the filament-wound tank apparatus a stacked series of single layer, open weave reinforcing patches are imbedded in the wound filament structure and interdigitated with layers of the filament winding thereof, the tank opening which sealingly receives the electric heating element extending through holes in the individual patches which are created when the element opening is cut through the wound filament structure and a wall portion of the underlying tank body. Alternatively, a single patch, imbedded in the filament winding or placed directly against the inner tank body, may be used in suitable applications. As another alternative, the patches may have pre-formed holes therein through which the subsequently formed element opening passes. The pre-formed holes in the patches have peripheries which may be reinforced, as by a knitting or weaving procedure.

The use of single layer, open weave patches imbedded in the wound filament structure or placed directly against the inner tank body permits resin applied to the filament winding and/or to the patches to easily flow into, around and through the patches to allow a more thorough and complete resin bonding between and among the patch and winding fiber portions of the overall reinforcing structure surrounding the underlying tank body. Moreover, the use of single layer, open weave reinforcing patches substantially eliminates the problem of patch delamination, and also reduces the stress-inducing bending of the filament winding at the patch edges.

In other forms of the invention, the filament portion of the tank structure may be of a non-wound type (such as chopped fiberglass, for example), and the finished tank structure may lack an inner tank body, the tank wall being defined by a filament-based material deposited externally on a subsequently removed bladder or mandrel structure.

DETAILED DESCRIPTION

Figure 1:
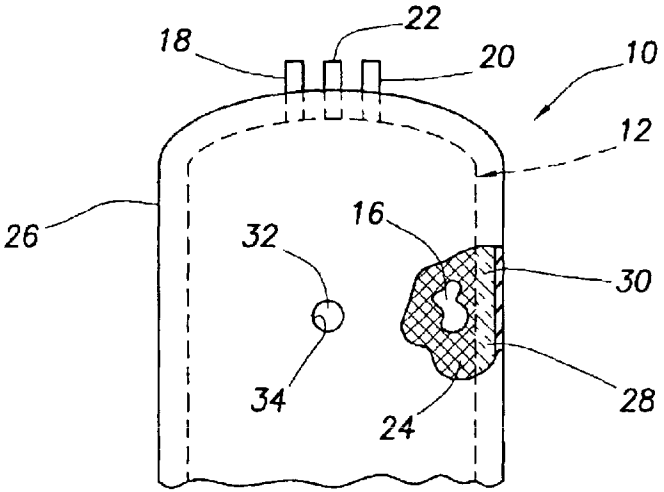
FIG. 1 is a simplified, partially sectioned side elevational view of an upper portion of an electric water heater embodying principles of the present invention.
Figure 2:
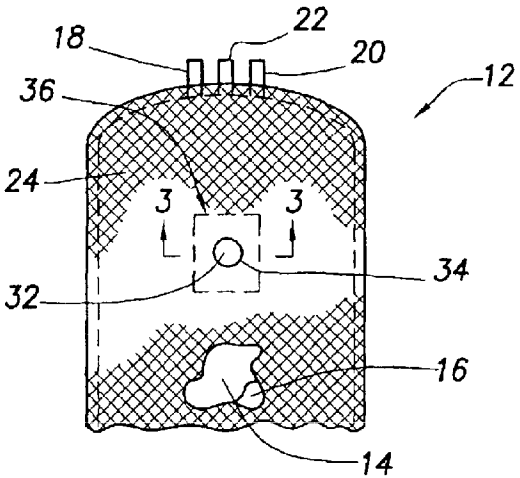
FIG. 2 is a simplified, partially sectioned side elevational view of a specially designed filament wound storage tank portion of the water heater which has been removed from the water heater for illustrative purposes.

Referring initially to FIGS. 1 and 2, in a preferred embodiment thereof, the present invention provides an electric water heater 10 (an upper portion of which is shown in FIG. 1) having a specially designed filament-wound water storage tank portion 12 incorporated therein and adapted to hold a quantity of pressurized water 14 to be heated for on-demand delivery from the tank. Tank 12 has an inner body portion 16, representatively of a blow-molded plastic construction, from the upper end of which three pipe sections upwardly extend—a cold water inlet pipe 18, a hot water outlet pipe 20, and a temperature and pressure relief pipe 22 If desired, a variety of other materials could be utilized for the inner body portion 16 including, but not limited to, injection molded plastic and metal.

The inner tank body portion 16 is externally reinforced by means of a resin-impregnated filament winding structure 24 (representatively a fiberglass filament material) which is wrapped around the outer surface of the tank body 16, in a series of layers, in a combination of helical and circumferential wraps. After the winding structure 24 is applied to the inner tank body portion 16 it is hardened thereon by a suitable resin curing process. Alternatively, another filament or fiber-based reinforcing material (such as, for example, a chopped fiberglass material) could be substituted for the winding structure in certain applications without departing from principles of the present invention.

Extending outwardly around the tank 12 is an outer jacket structure 26 which defines around the tank 12 an insulation cavity 28 filled with a suitable insulation material 30, representatively hardened foam insulation material As illustrated in FIG. 1, the pipes 18,20,22 extend outwardly through an upper end portion of the jacket 26.

Heating apparatus is provided for heating the pressurized water 14 stored in the tank 12 and representatively includes a schematically depicted electrical resistance immersion type heating element 32 sealingly extending into the interior of the tank 12 through an opening 34 cut through the filament winding 24 and a sidewall portion of the inner tank body 16 after the formation of the tank 12.

According to a key aspect of the present invention, a specially designed patch structure 36 which circumscribes the opening 34 is incorporated in the tank 12 and serves to reinforce it around the opening 34 by substantially reducing the filament weakness around the periphery of the opening 34 caused by the cutting of the filament fibers bordering it.

Figure 3:
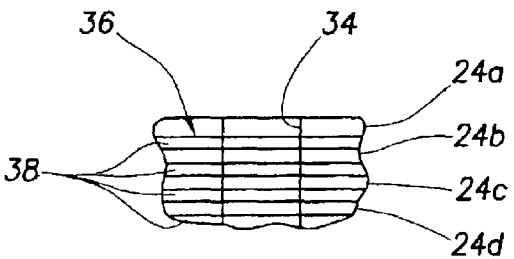
FIG. 3 is an enlarged scale schematic cross-sectional view through a portion of a unique tank hole-reinforcing structure incorporated in the tank.
Figure 4:
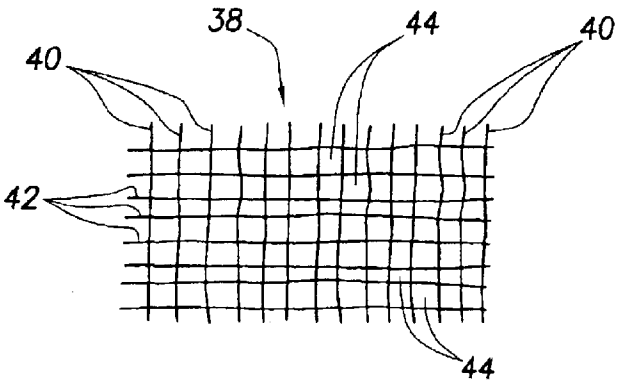
FIGS. 4–7 are enlarged scale side elevational views of portions of representative single layer, open weave patches used in the overall reinforcing patch structure.

Referring now to FIGS. 2–4, patch structure 36 representatively comprises a stacked series of single layer, open weave patch members 38 interdigitated with and resin-bonded to layers of the filament winding 24—filament winding layers 24*a*–24*d* being illustratively shown in FIG. 3, with layer 24*a* being the outermost filament layer. A portion of one of the individual single layer, open-weave patches 38 is shown in FIG. 4. Representatively, each patch member 38 may be formed from a variety of suitable materials such as, for example, fiberglass, carbon, kevlar, etc. As can be seen in FIG. 4, each patch member 38 has a spaced series of parallel individual strands 40 secured at an angle (representatively ninety degrees) to another spaced series of parallel individual strands 42, with substantial through-holes 44 bordered by the individual strands 40,42 being present in the patch 38.

The use of the single layer, open weave patch members 38 to reinforce the tank hole 34 provides various advantages compared to conventionally utilized patch methods for doing so. For example, the use of an open weave type patch desirably permits resin to flow around the patch fibers and through the open weave to lock the patch in place and to completely bond it to the other layers in the outer reinforcing portion of the overall tank structure. This better allows the patch fibers or strands to transfer the load on the tank fibers around the tank hole without the prior problems of patch delamination. Allowing the resin to completely flow in, around and through each patch allows a more complete bonding between all of the layers of the tank. Additionally, the single layer nature of each patch substantially prevents the stress-inducing sharp bending of the winding filaments contiguous with the edges of the installed patches.

While each of the individual patches 38 is illustratively shown as being of a single strand variety, with each of the sets of strands 40,42 being of the same material, and the strand sets being generally perpendicular to one another, a variety of other patch configurations could be utilized If desired. For example the weave can be of different types, shapes and size as long as it is an open weave pattern. The open weave pattern can be adjusted to suit different strength requirements. It can be vary from single strand construction with small openings to multiple woven strands with relatively large openings. The weave pattern could be different in the weft and warp directions to suit the specific loading direction in the application, and other configurational modifications could be made to the patches without departing from principles of the present invention. Additionally, while the patches are shown as being interdigitated with the various filament winding layers, it will be appreciated that the innermost patch could be placed directly against the outer surface of the inner tank body if desired. Moreover, while the patch structure has been representatively illustrated as comprising a stacked series of individual patches, in suitable applications it could alternatively be defined by a single patch—either imbedded in the filament winding or other filament or fiber-based material, or placed directly against the inner tank body.

Figure 6:
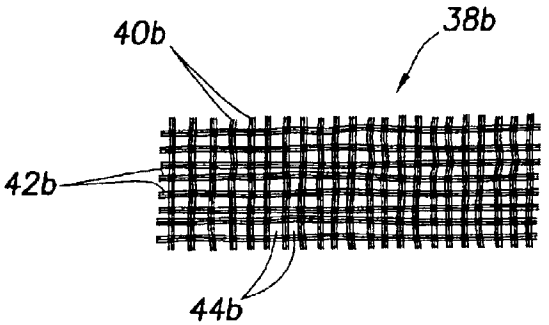
Figure 5:
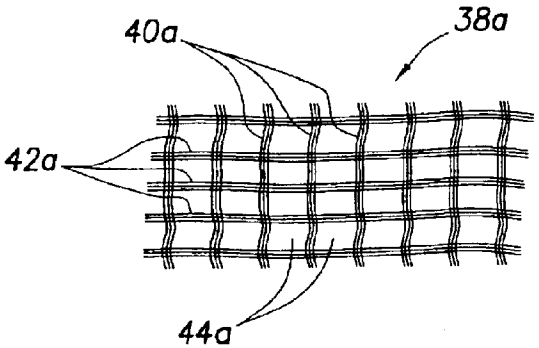

As an example of one possible alternate type of patch, the portion of the single layer, open weave patch 38*a* shown in FIG. 5 is of a single layer, open weave construction in which each of the strands 40*a*,42*a* is formed from a group of individual patch strands 40 or 42 as opposed to the single strand patch construction shown in FIG. 4. As an example of another possible type of alternate patch, the portion of the single layer, open weave patch 38*b* shown in FIG. 6 has strand structures 40*b*,42*b* formed each formed from multiple individual strands, and has smaller through-openings 44*b*.

Figure 7:
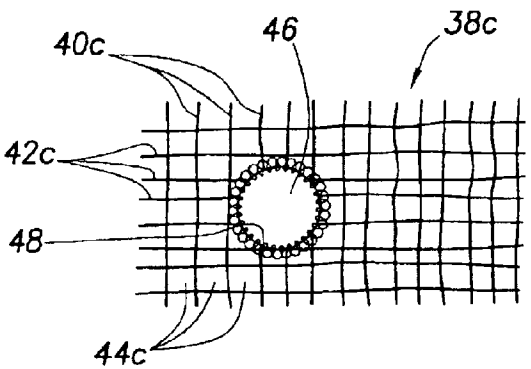

As previously described herein, the tank opening 34 is illustratively formed by cutting through the filament winding 24 and the individual patch portions 38 of the patch structure 36 after the patches 38 have been operatively disposed in the filament winding. According to another aspect of the present invention, shown in FIG. 7 in conjunction with the alternate patch member embodiment 38*c*, openings 46 may be pre-formed in each of the patch members 38*c* prior to their operative placement in the filament winding structure 24, with the peripheries 48 of the patch openings 46 being reinforced by, for example, weaving or knitting the patch fibers around the periphery of the pre-formed opening 46. Alternatively, pre-formed patch holes without reinforced peripheries could be utilized.

When the patches 38*c*, with their preformed, reinforced openings 46 are interdigitated with and resin-bonded to the various layers of the filament winding structure 24 the patch openings 46 (which may be slightly larger than the tank opening 34) are aligned with the location of the still to be formed tank opening 34. Thus, when the tank opening 34 is later formed only the filament winding layers are cut—no cutting of any of the patch strands results from this hole cutting operation.

While the present invention has thus far been representatively illustrated and described as being incorporated in the storage tank portion of a water heater, it is to be clearly understood that principles of the invention are in no manner limited to water heaters and can alternatively be utilized to advantage in conjunction with a variety of other types of filament-wound or other filament or fiber-based pressure vessels. Similarly, while the patch-based hole reinforcement technique representatively illustrated and described herein has been used in conjunction with a tank hole through which an electric heating element is operatively inserted, such technique can also be utilized in conjunction with a wide variety of other structures inserted through a tank hole. Further, the patch-based vessel reinforcing techniques illustrated and described herein may be used to reinforce vessel holes located in portions of vessels other than their sidewalls.

Figure 8:
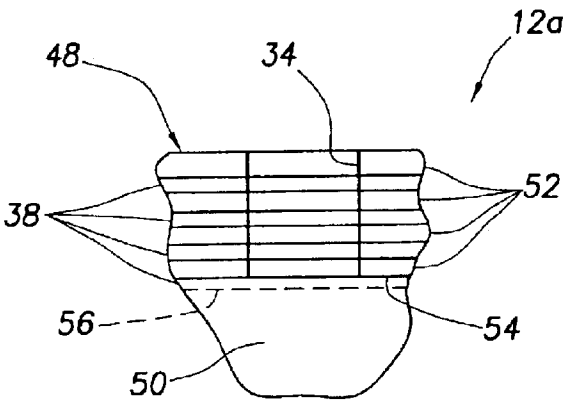
FIG. 8 is a schematic cross-sectional view through an alternate fiber-based tank structure also embodying principles of the present invention.

Cross-sectionally depicted in schematic form in FIG. 8 is a portion of an alternate embodiment 12*a* of the previously described tank 12. Tank 12*a* has a filament or fiber-based wall structure 48 which surrounds the interior 50 of the tank 12*a*, the wall structure 48 being representatively defined by layers 52, which may be filament winding layers, chopped fiber layers or other types of fiber/filament layers, impregnated with a cured resin material and interdigitated with single layer, open weave patch members 38 as previously described in conjunction with the tank 12.

The patch members 38 are locked to the filament layers 52 by the cured resin material impregnating the entire wall structure 48, and the reinforced opening 34 extends into the tank interior 50 through the interdigitated patch members 38 and filament layers 52. The opening portions extending through the patch members 38 may be formed when the opening 34 is formed through the wall structure 48, of the patch members 38 may have pre-formed, reinforced holes formed therethrough as previously described in conjunction with the patch member 38*c* shown in FIG. 7.

It should be noted that the tank apparatus 12*a* schematically shown in FIG. 8 is not provided with an inner tank body which is reinforced by the filament/fiber-based wall structure 48. Instead, the interior surface 54 of the wall structure 48 defines the interior surface of the finished tank apparatus 12*a*. This is achieved by forming the wall structure 48 on the outer surface of an appropriately shaped mandrel or bladder 56 (shown in phantom in FIG. 8) which is removed after the formation thereon of the filament/fiber-based wall structure 48.

The foregoing detailed description is to be clearly understood as being given by way of illustration and example only, the spirit and scope of the present invention being limited solely by the appended claims.

What is claimed is:

1. Filament-wound tank apparatus comprising:

a tank;

a wound filament structure extending externally around and reinforcing said tank in a circumscribing relationship therewith, said wound filament structure having an outer surface;

at least one single layer, open weave reinforcing patch disposed between said tank and said outer surface of said wound filament structure and being secured to said wound filament structure; and an opening extending into the interior of said tank from said outer surface of said wound filament structure and through said at least one single layer, open weave reinforcing patch.

2. The filament-wound tank apparatus of claim 1 wherein:

said tank is a water heater storage tank.

3. The filament-wound tank apparatus of claim 1 wherein:

said tank is of a non-metallic construction.

4. The filament-wound tank apparatus of claim 1 wherein:

said tank is of a plastic construction.

5. The filament-wound tank apparatus of claim 1 wherein:

said tank is of a blow-molded plastic construction.

6. The filament-wound tank apparatus of claim 1 wherein:

said at least one single layer, open weave reinforcing patch is imbedded in said wound filament structure.

7. The filament-wound tank apparatus of claim 1 wherein:

said wound filament structure is defined by a multi-layer filament winding impregnated with a cured resin material, and said at least one single layer, open weave reinforcing patch is impregnated with, and adhered to said wound filament structure by, said cured resin material.

8. The filament-wound tank apparatus of claim 1 wherein:

said at least one single layer, open weave reinforcing patch is a stacked series of single layer, open weave reinforcing patches interdigitated with layers of said wound filament structure, said opening extending through each patch.

9. The filament-wound tank apparatus of claim 8 wherein:

each of said single layer, open weave reinforcing patches has a pre-formed hole extending therethrough and through which said opening passes, said pre-formed hole having a reinforced periphery.

10. The filament-wound tank apparatus of claim 1 wherein:

said at least one single layer, open weave reinforcing patch has a pre-formed hole therein through which said opening extends.

11. The filament-wound tank apparatus of claim 10 wherein:

said at least one single layer, open weave reinforcing patch is imbedded in said wound filament structure.

12. The filament-wound tank apparatus of claim 10 wherein:

said pre-formed hole has a reinforced periphery.

13. The filament-wound tank apparatus of claim 1 wherein:

said tank has a generally cylindrical configuration with a side wall portion, and said opening extends through said side wall portion.

14. The filament-wound tank apparatus of claim 1 further comprising:

a structure sealingly extending through said opening into said tank.

15. A water heater comprising:

a tank adapted to hold a quantity of water to be heated;

a wound filament structure extending externally around and reinforcing said tank in a circumscribing relationship therewith, said wound filament structure having an outer surface;

at least one single layer, open weave reinforcing patch disposed between said tank and said outer surface of said wound filament structure and being secured to said wound filament structure;

an opening extending into the interior of said tank from said outer surface of said wound filament structure and through said at least one single layer, open weave reinforcing patch;

heating apparatus for heating water in said tank;

a jacket structure extending outwardly around said wound filament structure and forming therebetween a cavity; and insulation disposed within said cavity.

16. The water heater of claim 15 wherein:

said water heater is an electric water heater, and said heating apparatus includes an electric heating element sealingly extending through said opening into the interior of said tank.

17. The water heater of claim 15 wherein:

said tank is of a non-metallic construction.

18. The water heater of claims 15 wherein:

said tank is of a plastic construction.

19. The water heater of claim 15 wherein:

said tank is of a blow-molded plastic construction.

20. The water heater of claim 15 wherein:

said at least one single layer, open weave reinforcing patch is imbedded in said wound filament structure.

21. The water heater of claim 15 wherein:

said wound filament structure is defined by a multi-layer filament winding impregnated with a cured resin material, and said at least one single layer, open weave reinforcing patch is impregnated with, and adhered to said wound filament structure by, said cured resin material.

22. The water heater of claim 15 wherein:

said at least one single layer, open weave reinforcing patch is a stacked series of single layer, open weave reinforcing patches interdigitated with layers of said wound filament structure, said opening extending through each patch.

23. The water heater of claim 22 wherein:

each of said single layer, open weave reinforcing patches has a pre-formed hole extending therethrough and through which said opening passes, said pre-formed hole having a reinforced periphery.

24. The water heater of claim 15 wherein:

said tank has a generally cylindrical configuration with a side wall portion, and said opening extends through said side wall portion.

25. The water heater of claim 15 wherein:

said at least one single layer, open weave reinforcing patch has a pre-formed hole through which said opening extends.

26. The water heater of claim 27 wherein:

said preformed hole has a reinforced periphery.

27. The water heater of claim 15 further comprising:

a structure sealingly extending through said opening into said tank.

28. Tank apparatus comprising:

a filament-based wall structure;

a single layer, open weave reinforcing patch secured to said wall structure; and an opening extending into the interior of said tank apparatus through said wall structure and said reinforcing patch.

29. The tank apparatus of claim 28 wherein:

said tank apparatus is a water heater storage tank.

30. The tank apparatus of claim 28 further comprising:

a structure sealingly extending through said opening into the interior of said tank apparatus.

31. The tank apparatus of claim 28 wherein:

said reinforcing patch is imbedded in said filament-based wall structure.

32. The tank apparatus of claim 28 wherein:

said filament-based wall structure has an interior surface defining the interior surface of said tank apparatus.

33. The tank apparatus of claim 28 wherein:

said tank apparatus further comprises an inner tank body reinforcingly enveloped by said filament-based wall structure.

34. The tank apparatus of claim 28 wherein:

said wall structure and said reinforcing patch are intersecured by a cured resin material portion of said wall structure.

35. The tank apparatus of claim 28 wherein:

said wall structure comprises a filament winding material impregnated with a cured resin material.

36. The tank apparatus of claim 28 wherein:

said wall structure comprises chopped fiber material impregnated with a cured resin material.

37. The tank apparatus of claim 28 wherein:

said reinforcing patch has a pre-formed hole therein through which said opening extends.

38. The tank apparatus of claim 37 wherein:

said pre-formed hole has a reinforced periphery.

39. A water heater comprising:

tank apparatus for storing a quantity of water to be heated, said tank apparatus including a filament-based wall structure, a single layer, open weave reinforcing patch secured to said wall structure, and an opening extending into the interior of said tank apparatus through said wall structure and said reinforcing patch;

heating apparatus for heating water in said tank apparatus;

a jacket structure extending outwardly around said tank apparatus and forming therebetween a cavity; and insulation disposed within said cavity.

40. The water heater of claim 39 further comprising:

a structure sealingly extending through said opening into the interior of said tank apparatus.

41. The water heater of claim 39 wherein:

said reinforcing patch is imbedded in said filament-based wall structure.

42. The water heater of claim 39 wherein:

said filament-based wall structure has an interior surface defining the interior surface of said tank apparatus.

43. The water heater of claim 39 wherein:

said tank apparatus further comprises an inner tank body reinforcingly enveloped by said filament-based wall structure.

44. The water heater of claim 39 wherein:

said wall structure and said reinforcing patch are intersecured by a cured resin material portion of said wall structure.

45. The water heater of claim 39 wherein:

said wall structure comprises a filament winding material impregnated with a cured resin material.

46. The water heater of claim 39 wherein:

said wall structure comprises chopped fiber material impregnated with a cured resin material.

47. The water heater of claim 39 wherein:

said water heater is an electric water heater.

48. The water heater of claim 39 wherein:

said reinforcing patch has a pre-formed hole therein through which said opening passes.

49. The water heater of claim 48 wherein:

said pre-formed hole has a reinforced periphery.

* * * * *